US007022187B2

(12) United States Patent
Stockton

(10) Patent No.: US 7,022,187 B2
(45) Date of Patent: Apr. 4, 2006

(54) INSERT MASK FOR MASKING CEILING OR WALL FIXTURES

(76) Inventor: Everett Ray Stockton, 613 N. Impala Dr., Fort Collins, CO (US) 80521

( * ) Notice: Subject to any disclaimer, the term of this patent is extended or adjusted under 35 U.S.C. 154(b) by 0 days.

(21) Appl. No.: 10/390,750

(22) Filed: Mar. 25, 2003

(65) Prior Publication Data

US 2003/0186017 A1 Oct. 2, 2003

Related U.S. Application Data

(60) Provisional application No. 60/367,861, filed on Mar. 28, 2002.

(51) Int. Cl.
*B05C 21/00* (2006.01)

(52) U.S. Cl. ..... 118/504; 118/505

(58) Field of Classification Search ..... 118/504, 118/505, 500, 503, 423, 301, 406; 427/300, 427/282; 269/21, 75, 55, 46, 71, 72, 74; 228/47.1, 49.5; 279/3, 2.24
See application file for complete search history.

(56) References Cited

U.S. PATENT DOCUMENTS 4,559,245 A * 12/1985 Stark
4,825,805 A * 5/1989 Walker
5,091,220 A * 2/1992 Horiki et al. ..... 427/272
5,270,085 A * 12/1993 Horiki et al.
5,420,775 A * 5/1995 Kusmer ..... 362/376
5,468,538 A 11/1995 Nameche
5,631,055 A 5/1997 Vines et al.
6,022,582 A 2/2000 Vantyle
6,103,974 A * 8/2000 Erdfarb
6,270,886 B1 8/2001 Ono et al.
6,464,823 B1 10/2002 Vantyle

* cited by examiner

*Primary Examiner*—Brenda A. Lamb
(74) *Attorney, Agent, or Firm*—Patterson, Thuente, Skaar & Christensen, P.A.

(57) ABSTRACT

The present invention relates to an apparatus as well as systems and methods for masking ceiling or wall fixtures, such as recessed light fixtures, during residential and commercial painting and drywalling. Through the use of an insert mask, a user can quickly and safely mask a fixture without the use of special tools or ladders. Typically, the user positions the insert within a defined opening on the ceiling or wall fixture. The insert is fully inserted into the opening whereby a retaining surface on the insert creates a friction fit between the fixture and the insert. While the insert frictionally resides within the opening, any overspray or misapplication of painting or drywalling material is captured by a protective surface of the insert. Following the material application process, the insert can be removed from the fixture. In an embodiment, the insert mask system includes an insertion tool for insertion and removal of the insert from the fixture. Preferably, the insert is reusable and recyclable resulting in less waste than current masking practices.

15 Claims, 7 Drawing Sheets

INSERT MASK FOR MASKING CEILING OR WALL FIXTURES

RELATED APPLICATION

The present application claims priority to U.S. Provisional Application No. 60/367,861 entitled, "CAN MASKER WITH INSERTION/EXTRACTION TOOL," filed Mar. 28, 2002, which is hereby incorporated by reference.

FIELD OF THE INVENTION

The present invention relates generally to the field of masking accessories for use in residential and commercial painting and drywalling. More specifically, the present invention relates to an insert and insertion tool for use in masking fixtures having defined openings during the painting or drywalling of a wall or ceiling surface.

BACKGROUND OF THE INVENTION

The idea of masking fixtures prior to the painting of walls or ceilings is well known in the construction field. By masking the fixtures, a contractor can prevent paint or drywall texture from adhering to the fixture which may lead to aesthetic issues, emissions of vapors or fumes, as well as thermal overload. Proper masking allows the contractor to work faster when applying the desired coating and it reduces the amount of time spent on clean-up following the application.

A variety of methods are currently employed to mask fixtures. In its most basic form, a masking process can be as simple as applying household masking tape along the edge of a surface which is to be protected. Examples of such surfaces could include door frames, window frames, kitchen cabinetry, etc. In other cases, the masking process could include taping a protective covering, such as plastic sheeting, cardboard or paper, over an area to be protected such as a window or doorway. Finally, removable coatings can be applied to the area to be protected that prevent paint or drywall texture from adhering to the base layer. The removable coating and any deposited paint or texture can simply be wiped away following the painting or drywalling process. Examples of various masking methods and masking devices include U.S. Pat. No. 5,468,538 to Nameche, U.S. Pat. No. 5,631,055 to Vines et al., U.S. Pat. No. 6,022,582 to Van Tyle, U.S. Pat. No. 6,270,886 to Ono et al., and U.S. Pat. No. 6,464,823 to Van Tyle. While these inventions suggest alternative masking techniques, there are currently no quick and economical alternatives for masking wall and ceiling openings such as those presented by recessed light fixtures.

Recessed light fixtures have become increasingly popular in new construction as well as for remodeling projects. As the entire fixture is recessed within a can located within the ceiling or wall surface, recessed light fixtures assist in making the room seem larger and more open. Recessed light fixtures are also used to focus illumination in a single direction, allowing a homeowner to focus light in a desired area or on a particular item of interest. While the recessed orientation provides many desirable effects, recessed light fixtures can make a painting or drywalling application more difficult and time consuming. Contractors must take care to prevent any overspray or other misapplication of paint or texture within the recessed can. Typically, a contractor will tape a sheet of plastic, paper or cardboard that is cut to size over the can opening. This can be a labor intensive and difficult job as most recessed light fixtures are located overhead in the ceiling. This requires that the contractor work above his or her head while masking the can and will likely require the use of a ladder, chair or scaffolding to access the can opening.

While the previously mentioned masking methods and devices can be used, proper application of these methods and devices is time consuming and difficult when applied to ceiling and wall fixtures. In addition, use of these methods and devices often necessitate the use of a ladder, chair or scaffold resulting in additional set-up time as well as increased risks that are inherent with climbing and balancing. What is needed is a masking device that allows contractors to quickly mask a ceiling or wall fixture while reducing the potential safety issues associated with standard masking techniques.

SUMMARY OF THE INVENTION

The insert masking system of the present invention meets the requirements of speed and safety for masking ceiling or wall fixtures. Through the use of the insert masking system of the present invention, a contractor can quickly and easily mask the ceiling or wall fixture by positioning an insert within a defined opening of the fixture. The insert can also be adapted for use with an installation tool making it possible for a contractor to avoid using a ladder, chair or scaffold to mask the fixtures. Furthermore, application of the insert is simple and requires no special skills, dexterity or physical strength. In addition, the installation tool can be easily assembled using tools that are likely to be readily available to any painting or drywall contractor.

In one aspect, the present invention relates to an apparatus for masking ceiling or wall fixtures having defined openings. The apparatus comprises an insert having a retention surface designed to promote frictional attachment of the insert within the defined opening of the fixture. The insert further comprises a protective surface whereby paint or drywall texture is prevented from entering and adhering to the fixture. Preferably, the insert is molded from recyclable and reusable plastic polymers.

In another aspect, the present invention relates to a masking system for use in masking ceiling or wall fixtures during painting or drywalling of a ceiling or wall surface. The masking system comprises an insert and an insertion tool. Generally, the insert comprises a retaining surface, a protective surface and an interconnecting surface. The insertion tool is adapted to engage the interconnecting surface such that a user can install and remove the insert without the need for ladders or scaffolding. The insertion tool can include a handle assembly which is likely to be readily available to a painting or drywall contractor.

In another aspect, the present invention relates to a method for masking ceiling or wall fixtures during the painting or drywalling of a ceiling or wall surface. Generally, the method comprises placing an insert into the defined opening of the fixture. Following the painting or drywalling process, the insert is subsequently removed from the fixture. Insertion and removal of the insert can be accomplished by hand or alternatively, through the use of an insertion tool adapted for use with the insert.

DETAILED DESCRIPTION OF THE PREFERRED EMBODIMENTS

The insert mask system of the present invention allows a painting or drywalling contractor to quickly and safely mask recessed light fixtures located within ceiling or wall surfaces. In its most basic form, the insert mask system consists of an insert that frictionally resides within a defined opening of the ceiling or wall fixture. In a preferred embodiment, the insert mask system comprises an insert and an installation tool. As contained herein, the insert of the present invention is described with reference to a recessed light fixture. It will be understood that the insert is contemplated for use with other ceiling and wall fixtures having similarly defined openings.

Figure 1:
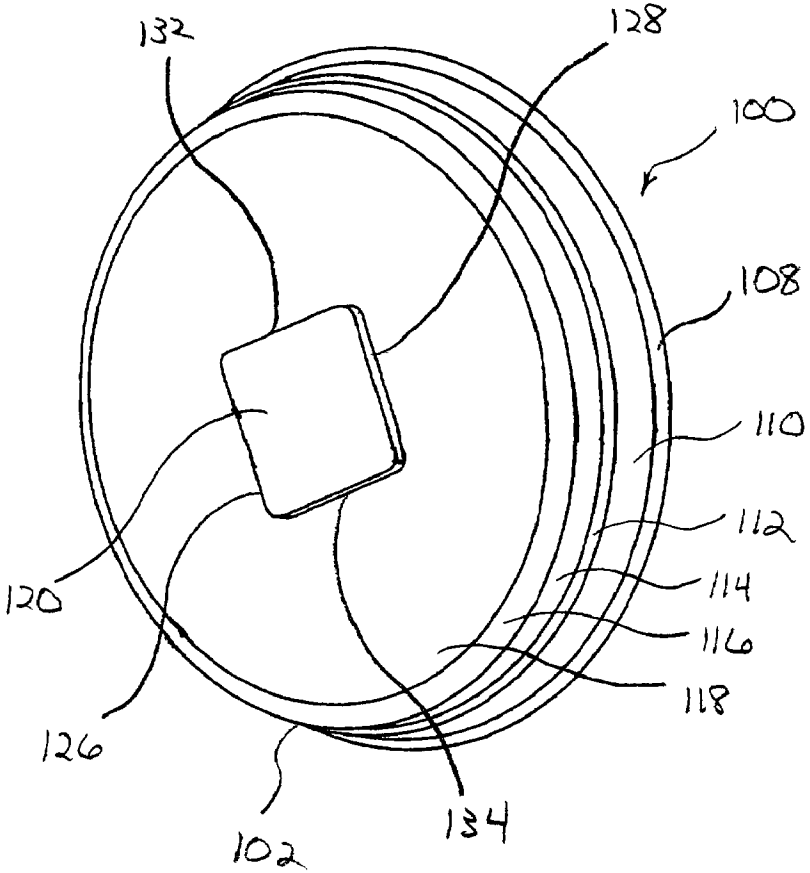
FIG. 1 is a perspective view of an insert of the insert mask system of the present invention.
Figure 2:
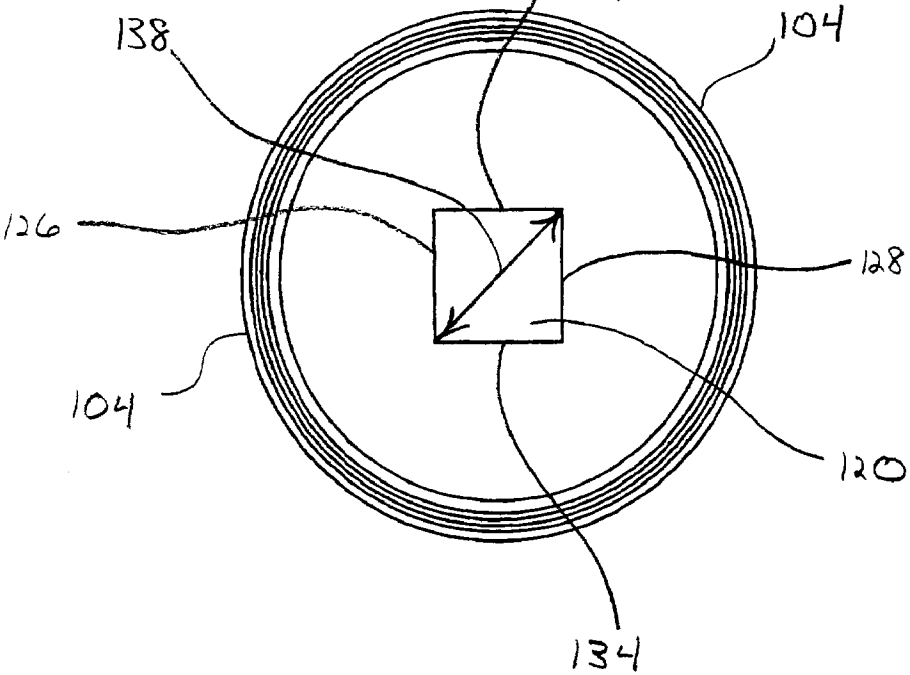
FIG. 2 is an end view of the insert.
Figure 3:
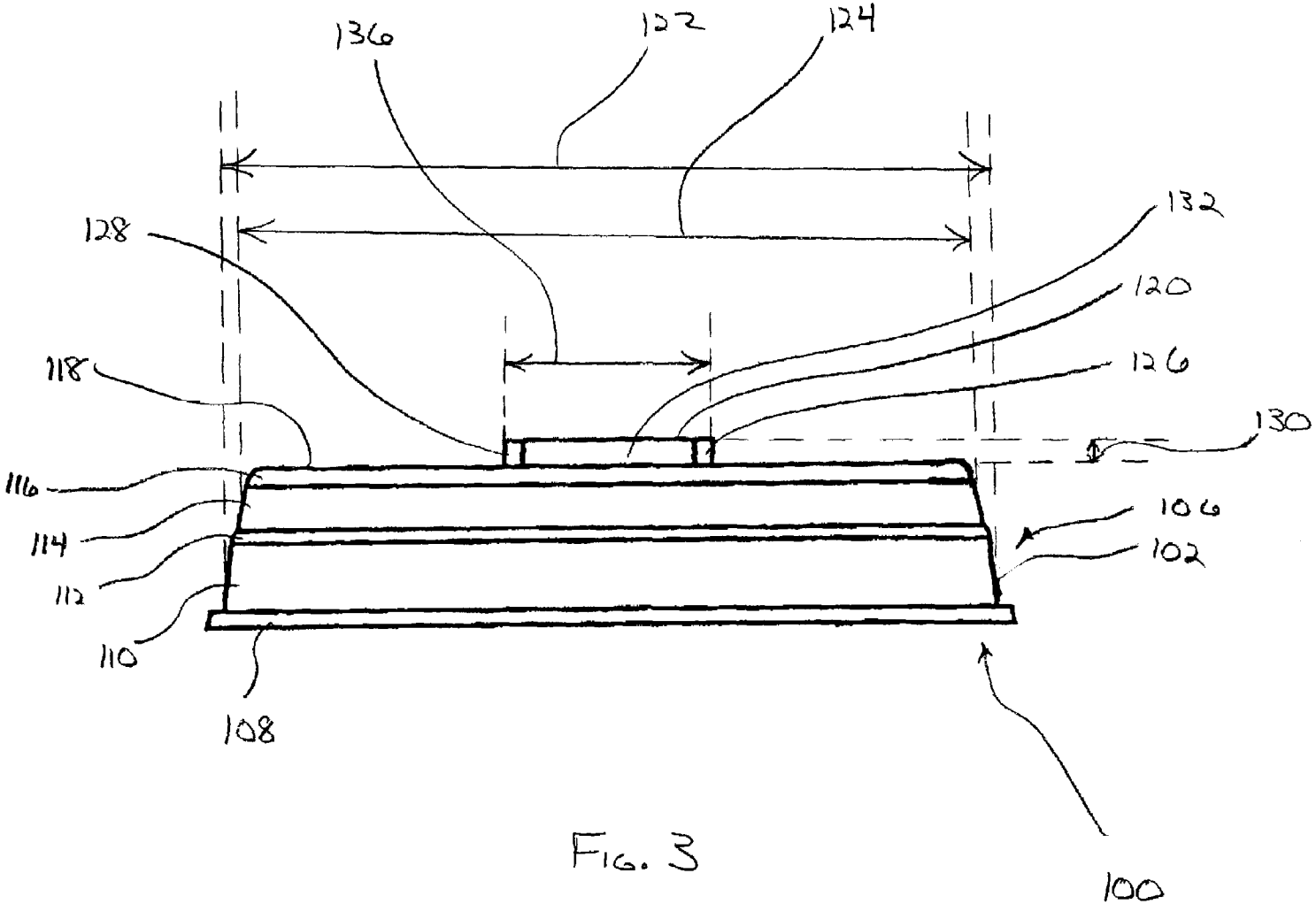
FIG. 3 is a side view of the insert.

As depicted in FIGS. 1–3, an embodiment of an insert 100 for use with a circular fixture includes an exterior side 102 and an interior side 104. In alternative embodiments, insert 100 can comprise other shapes such as an oval, square, rectangle, etc., corresponding to a defined opening of a recessed light fixture. In a preferred embodiment, insert 100 is molded from a reusable and recyclable plastic polymer, most preferably polyethylene. However, any reusable and recyclable moldable plastic polymer, such as polypropylene, polycarbonate, perflueroalkoxy, acrylonitrile butadiene styrene and polytetrafluoroethylene, could be used as well. Insert 100 has a mask profile 106 defined by a flanged lip 108, a retaining surface 110, a first transition surface 112, a guiding surface 114, a second transition surface 116, a protective surface 118, and an interconnecting surface 120. In a preferred embodiment, retaining surface 110 and guiding surface 114 are tapered such that a retaining surface diameter 122 and a guiding surface diameter 124 decrease as they approach protective surface 118. Generally, retaining surface diameter 122 will have a maximum diameter equal to a recessed can diameter. In practice, recessed can diameters vary but typical industry standards for recessed cans include 4 inch, 5 inch and 6 inch diameters. These dimensions are illustrative only and are not intended to limit the scope of the present invention. Generally, first transition surface 112 and second transition surface 116 have a rounded perimeter providing a smooth transition between surfaces. Interconnecting surface 120 is off-set from protective surface 118 by a pair of side walls 126, 128 having a wall height 130. Interconnecting surface 120, protective surface 118 and side walls 126, 128 define a pair of openings 132, 134. Preferably, interconnecting surface 120 has a square configuration defined by an interconnecting width 136 and a diagonal width 138. In an alternative embodiment, protective surface 118 is continuous such that the insert lacks interconnecting surface 120.

Figure 4:
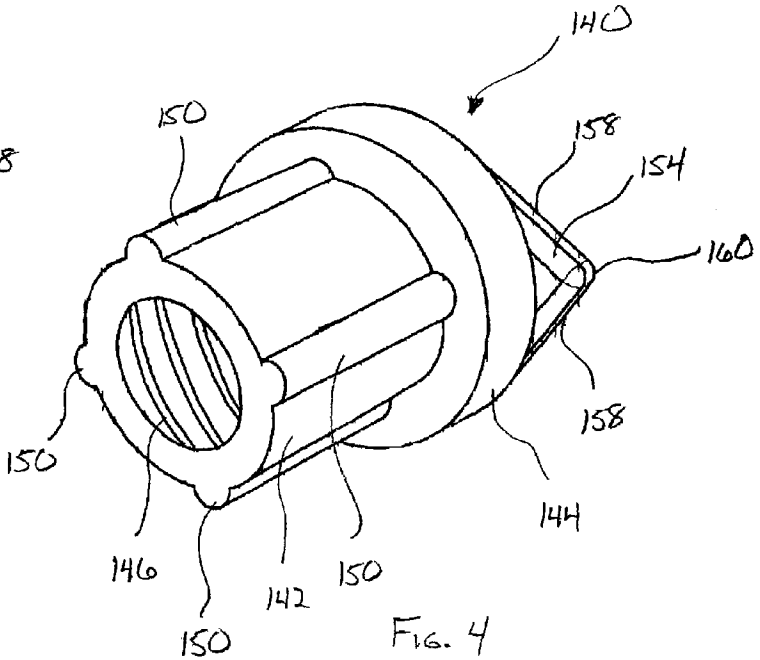
FIG. 4 is a perspective view of an installation member of the insert mask system of the present invention.
Figure 5:
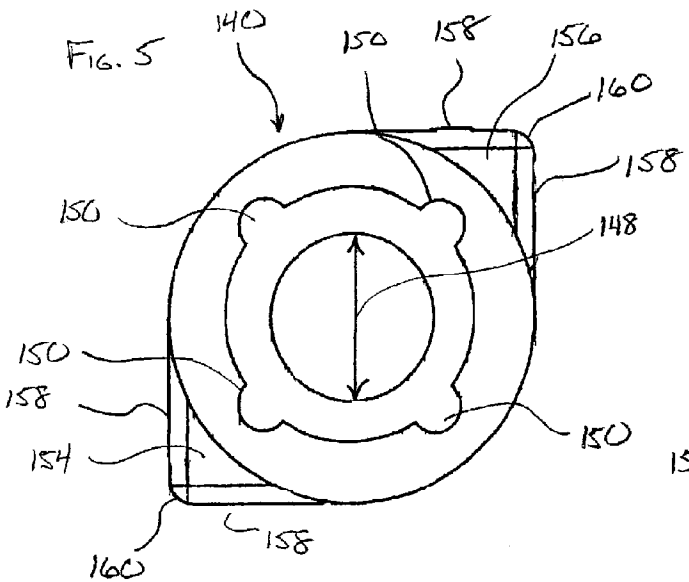
FIG. 5 is an end view of the installation member.
Figure 6:
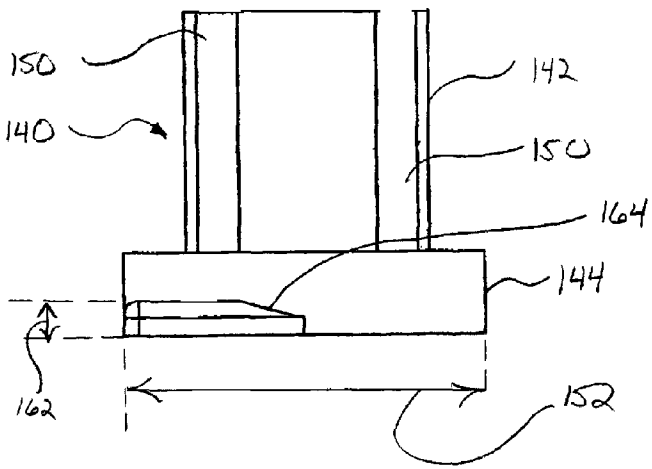
FIG. 6 is a side view of the installation member.

FIGS. 4–6 depict an installation member 140. In a preferred embodiment, installation member 140 is molded from the same reusable and recyclable plastic polymer, most preferably polyethylene, as insert 100. However, any reusable and recyclable moldable plastic polymer, such polypropylene, polycarbonate, perflueroalkoxy, acrylonitrile butadiene styrene and polytetrafluoroethylene, could be used as well. Installation member 140 includes a hollow, cylindrical body 142 and a circular insertion member 144. Cylindrical body 142 includes an internal thread 146 and an internal diameter 148. The exterior of cylindrical body 142 includes a plurality of strengthening columns 150. Circular insertion member 144 has an insertion diameter 152 slightly smaller than interconnecting width 136. Extending from circular insertion member 144 are a pair of opposed locking tabs 154, 156. Locking tabs 154, 156 are generally triangular in shape, each having a pair of tab sides 158 culminating at a tip 160. Locking tabs 154, 156 also have a tab thickness 162. Tab thickness 162 should be approximately equal to wall height 130. Tab sides 158 include a tapered leading edge 164. Locking tabs 154, 156 are sized such the distance between opposed tips 160 is slightly less than diagonal distance 138.

Figure 7:
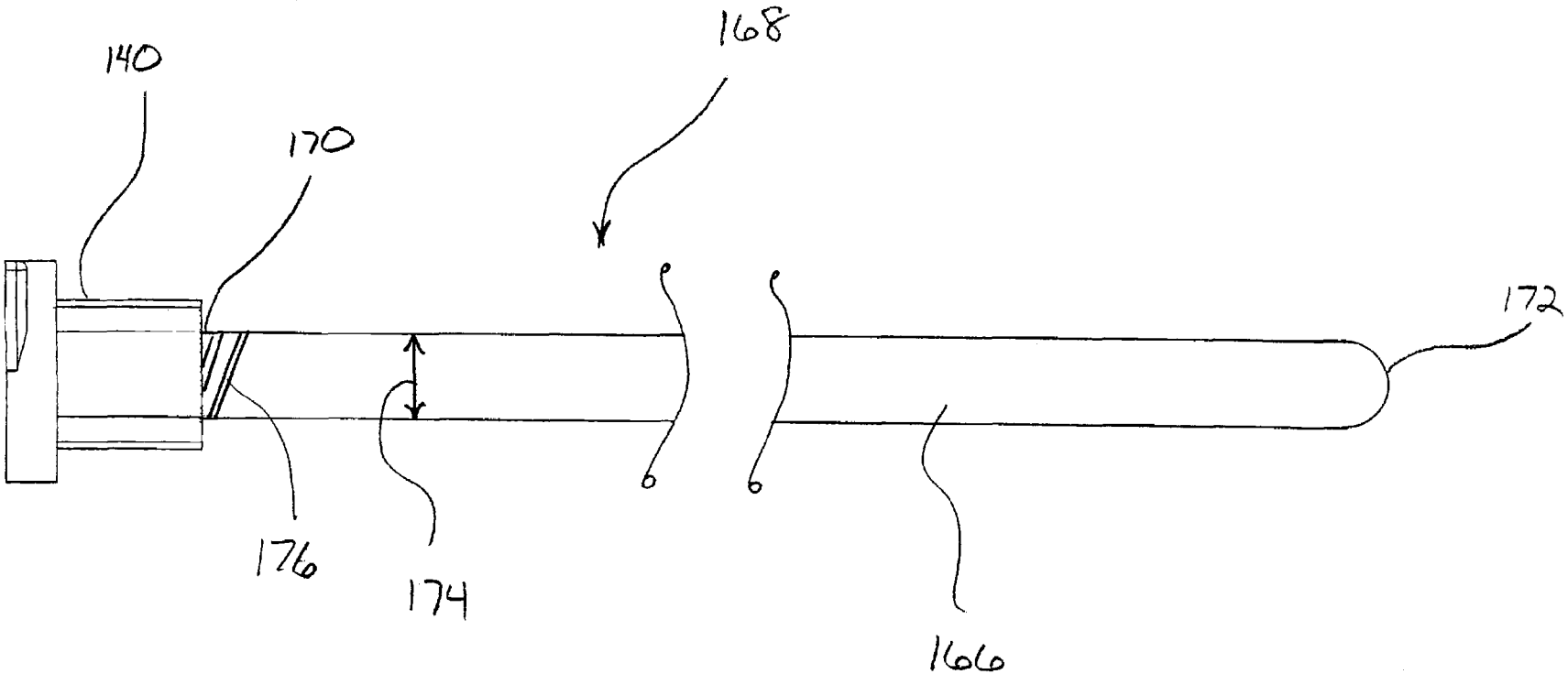
FIG. 7 is a side view of an installation tool of the insert mask system of the present invention.

As depicted in FIG. 7, installation member 140 is attached to a handle member 166 to form an installation tool 168. Handle member 166 is most typically an elongated cylindrical member including an attachment end 170, a handle end 172 and a handle diameter 174. In a preferred embodiment, handle member 166 has a primary use as an extension pole for use with a paint roller or dry wall applicator that is readily available to a painting or drywall contractor. If an extension pole is unavailable, a broom handle can be used as handle member 166. Handle member 166 can comprise any of the materials that would typically be used for an extension pole or broom handle such as wood, fiberglass, plastic polymers, aluminum and other metals. Generally, materials having properties making them both strong and lightweight are preferred for handle member 166. Handle member 166 includes an external thread 176 around the perimeter of attachment end 170.

Figure 8:
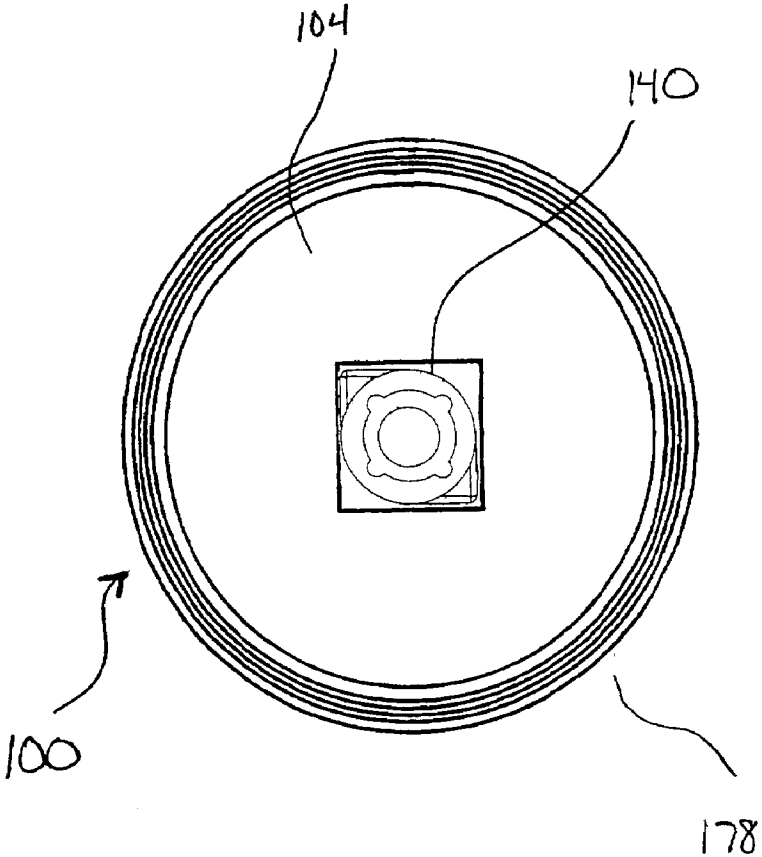
FIG. 8 is an end view of a masking assembly of the insert mask system of the present invention in an unlocked disposition.

FIG. 8 depicts insert 100 and installation member 140 in an unlocked disposition 178. In the unlocked disposition 178, locking tabs 154, 156 lie in the off-set space created by side walls 126, 128 such that locking tabs 154, 156 are below the protective surface 118.

Figure 9:
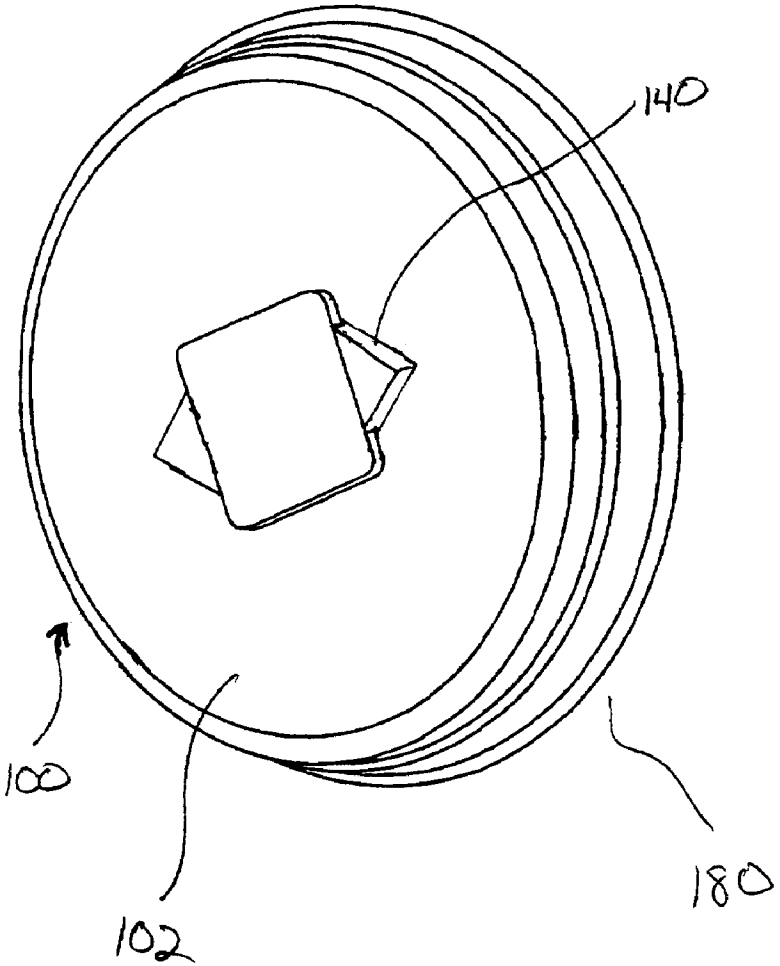
FIG. 9 is a perspective view of the masking assembly in a locked disposition.

FIG. 9 depicts insert 100 and installation member 140 in a locked disposition 180. Locking tabs 154, 156 project through openings 132, 134 created by side walls 126, 128.

Figure 10:
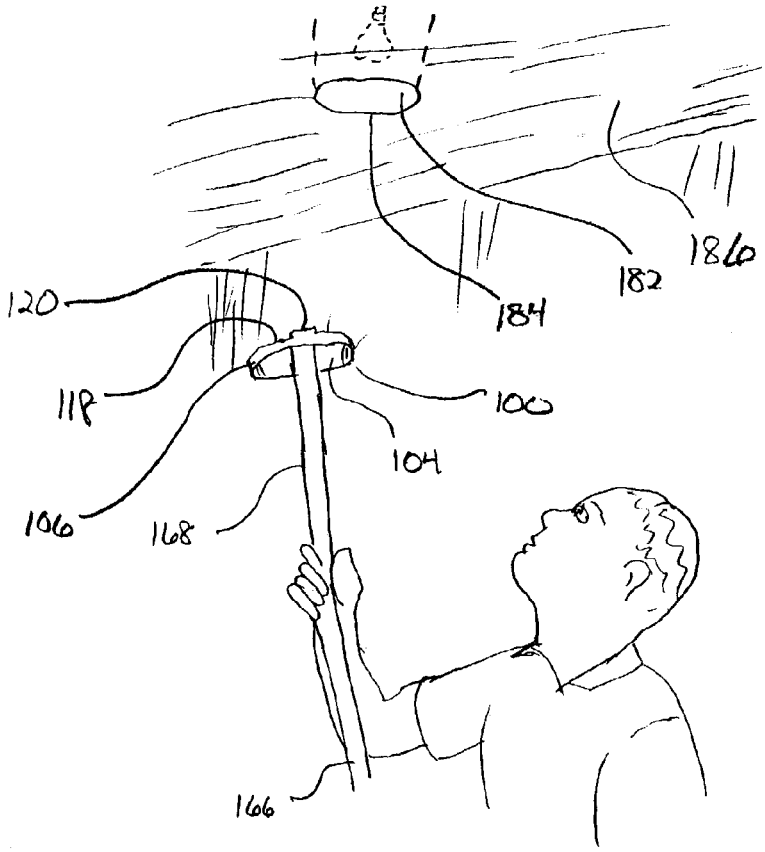
FIG. 10 is a perspective view of a user installing the insert mask system of the present invention.
Figure 11:
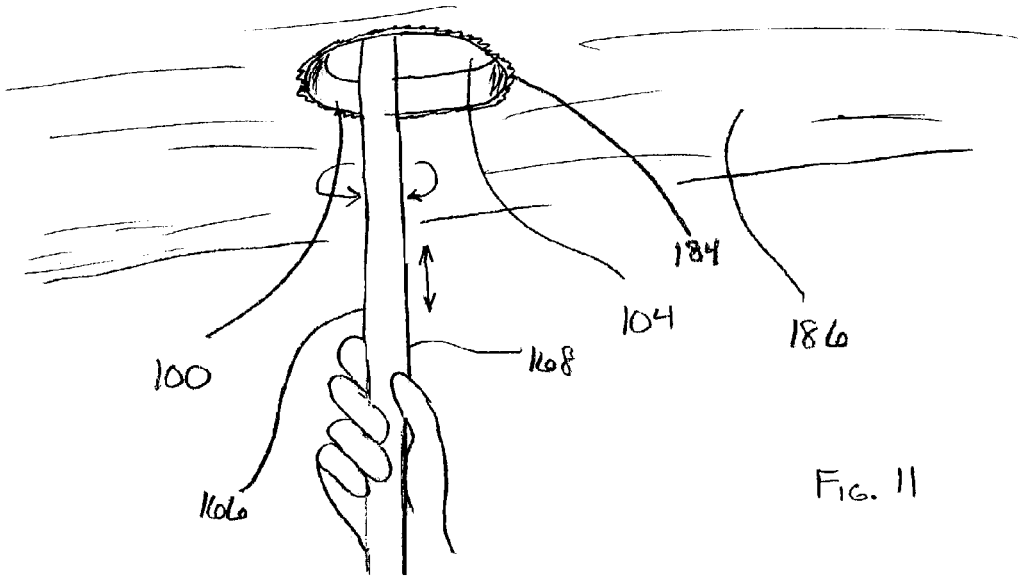
FIG. 11 is a perspective view of a user installing the insert mask system.
Figure 12:
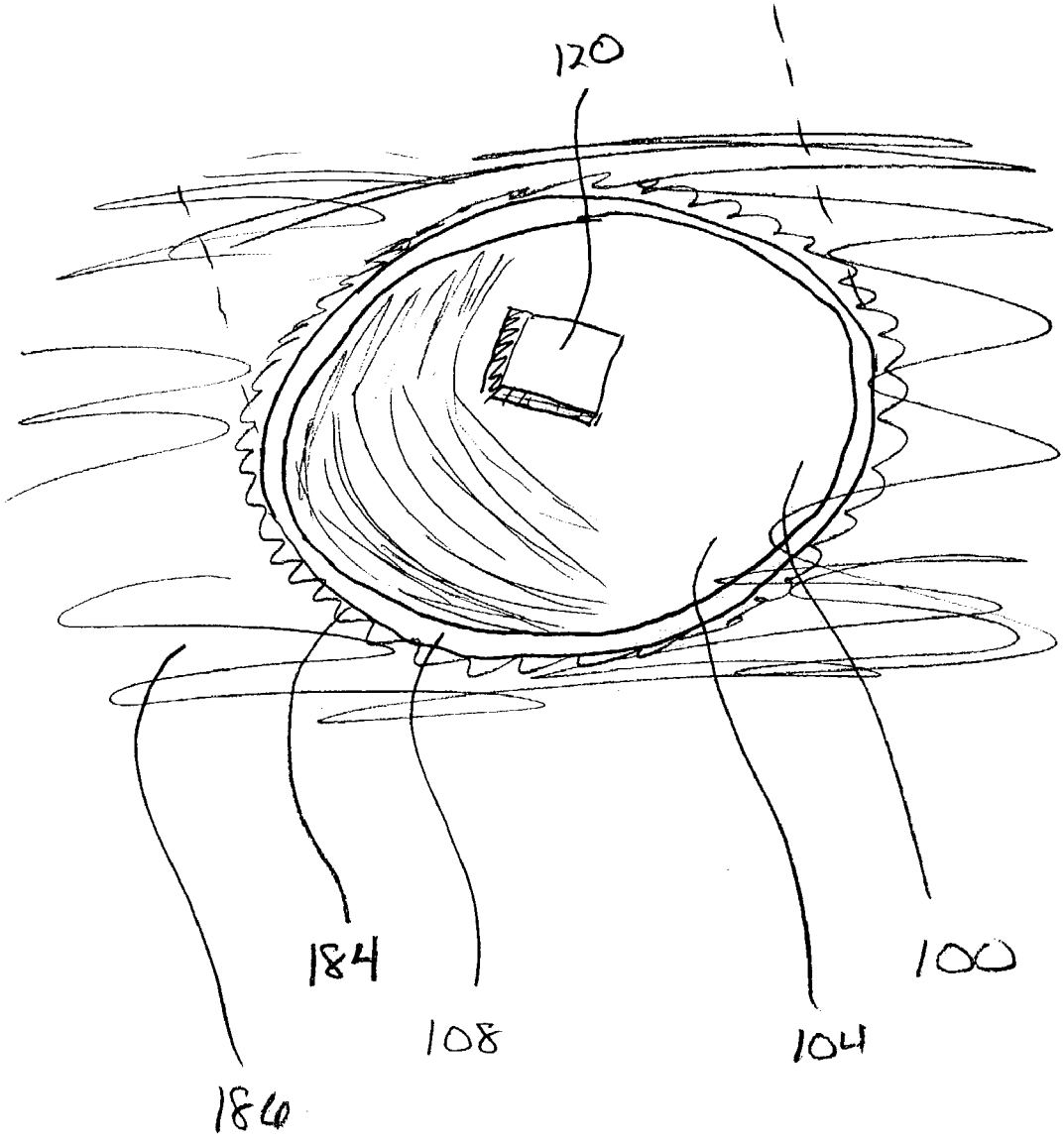
FIG. 12 is a perspective view of an installed insert.

FIGS. 10–12 depict the can mask system of the present invention in actual use. The first step in using insert 100 of the present invention is to assemble installation tool 168. Generally, handle member 166 is selected such that handle diameter 174 is slightly smaller than internal diameter 148. Attachment end 170 and cylindrical body 142 are then placed into proximity such that the external thread 176 and internal thread 146 can be used to rotatably couple handle member 166 and installation member 140.

Following the assembly of installation tool 168, insert 100 is coupled to installation tool 168. Insert 100 is positioned such that interior surface 104 is facing installation member 140. Insert 100 is then placed over the installation member 140 such that installation member 140 abuts the interconnecting surface 120 in the unlocked disposition 178. The user rotates installation member 140 approximately 45° in either a clockwise or counter-clockwise direction. This rotation causes locking tabs 154, 156 to enter the openings 132, 134 resulting in locked disposition 180.

Once insert 100 is physically coupled to installation tool 168, a user directs handle member 166 such that protective surface 118 is inserted into a defined opening 182 of a fixture 184. Examples of fixture 184 include a recessed light fixture or a skylight. As protective surface 118 is inserted, second transition surface 116, guiding surface 114 and first transition surface 112 interact with defined opening 182 to evenly position insert 100 within defined opening 182. As retaining surface 110 comes into contact with defined opening 182, a friction fit is created as retaining surface diameter 122 approaches the diameter of defined opening 182. Insertion of mask insert 100 is complete when flanged lip 108 comes into contact with a ceiling or wall surface 186. When the insertion of insert 100 is completed, the user uncouples the installation tool 168 by rotating the installation tool 168 45° causing the installation member 140 to move into the unlocked disposition 178. The user then lowers the installation tool 168 while insert 100 remains in place. The user is then free to paint or apply drywall without concern as to overspray or misapplication of material into the recessed can as this material would adhere to the interior side 104 of mask insert 100.

Upon completion of the painting or drywalling process, the user allows the material to dry and then removes the inset 100. First, the user positions the installation tool 168 such that insertion member 140 is in the unlocked disposition 178. Next, the user rotates the handle member 166 45° such that the locking tabs 154, 156 are in the locked disposition. Finally, the user then pulls on the handle member 166 to overcome the friction fit and the insert 100 is removed from defined opening 182. Insert 100 can then be removed from the installation tool 168 or reinserted into a second fixture (not depicted). When the contractor completes the work, insert 100 can be recycled, reused or discarded.

While a preferred embodiment of a method for using the can mask system of the present invention has been described within the context of using installation member 140 and installation tool 168, it will be obvious to one skilled in the art that insert 100 can be inserted into and removed from the defined opening 182 of fixture 184 by hand.

Although various embodiments of the present invention have been disclosed here for purposes of illustration, it should be understood that a variety of changes, modifications and substitutions may be incorporated without departing from either the spirit or scope of the present invention.

What is claimed is:

1. An insert for masking a fixture having a defined opening, the insert comprising:

a retention surface, wherein said retention surface includes a profile to frictionally engage said fixture; and a protective surface, wherein said protective surface is connected to said retention surface, wherein said protective surface substantially covers said defined opening when said retention surface is frictionally engaged with said fixture; and a connecting surface and wherein the connecting surface is offset from said protective surface by a pair of opposed side walls so as to define a pair of tool-engaging slot openings adapted to receive a tool enabling removal of said retention surface from said fixture.

2. The insert of claim 1, wherein the profile is tapered to promote insertion of the retention surface into said defined opening.

3. The insert of claim 1, wherein the retention surface defines a circle.

4. The insert of claim 3, wherein the circle has a diameter greater than or equal to 3 inches.

5. The insert of claim 1, wherein the insert is molded from a reusable and recyclable plastic polymer.

6. The insert of claim 5, wherein the plastic polymer is selected from the group consisting essentially of: polyethylene, polypropylene, polycarbonate, perflueroalkoxy, acrylonitrile butadiene styrene, and polytetrafluoroethylene.

7. The insert of claim 1, wherein the fixture comprises a recessed light fixture.

8. A mask system for masking a fixture having a defined opening, the mask system comprising:

an insert, wherein said insert includes a retention surface and wherein said retention surface includes a profile to frictionally engage said fixture, wherein said insert includes a protective surface connected to said retention surface, wherein said protective surface substantially covers said defined opening when said retention surface is frictionally engaged with said fixture; and an installation member, wherein said installation member includes a handle member and an insertion connector, where said insertion connector is operably couplable to said handle member, wherein said insertion connector is removably couplable to said insert, and wherein said installation member enables the frictional engagement of said insert with said defined opening when said installation member is coupled to said insert, and wherein the insertion connector and the protective surface are rotatably couplable, and wherein the insertion connector includes a pair of locking tabs.

9. The system of claim 8, wherein the handle member is selected from the group consisting essentially of: a broom handle and an extension pole.

10. The system of claim 8, wherein the handle member and the insertion connector are rotatably couplable.

11. The system of claim 8, wherein the insert is molded of a recyclable and reusable plastic polymer.

12. The system of claim 11, wherein the plastic polymer is selected from the group consisting essentially of: polyethylene, polypropylene, polycarbonate, perflueroalkoxy, acrylonitrile butadiene styrene, and polytetrafluoroethylene.

13. The system of claim 8, wherein the insertion connector is molded of a recyclable and reusable plastic polymer.

14. The system of claim 13, wherein the plastic polymer is selected from the group consisting essentially of: polyethylene, polypropylene, polycarbonate, perflueroalkoxy, acrylonitrile butadiene styrene, and polytetrafluoroethylene.

15. A mask system for masking a fixture having a defined opening, the mask system comprising:

an insert, wherein said insert includes a retention surface and wherein said retention surface includes a profile to frictionally engage said fixture, wherein said insert includes a protective surface connected to said retention surface, wherein said protective surface substantially coven said defined opening when said retention surface is frictionally engaged with said fixture and wherein said insert further includes a connecting surfaced recessed from said protective surface and wherein said connecting surface defines a pair of openings; and an installation member, wherein said installation member includes a handle member and an insertion connector, where said insertion connector is operably couplable to said handle member, wherein said insertion connector is removably couplable to said insert, and wherein said installation member enables the frictional engagement of said insert with said defined opening when said installation member is coupled to said insert.

* * * * *